US011624533B2

(12) United States Patent
Kang et al.

(10) Patent No.: US 11,624,533 B2
(45) Date of Patent: Apr. 11, 2023

(54) EVAPORATOR

(71) Applicant: LG ELECTRONICS INC., Seoul (KR)

(72) Inventors: Jungho Kang, Seoul (KR); Jinhee Jeong, Seoul (KR); Hyunwook Han, Seoul (KR); Uisik Hwang, Seoul (KR); Heewoong Lee, Seoul (KR); Cheolmin Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 24 days.

(21) Appl. No.: 17/171,260

(22) Filed: Feb. 9, 2021

(65) Prior Publication Data

US 2021/0254871 A1 Aug. 19, 2021

(30) Foreign Application Priority Data

Feb. 13, 2020 (KR) ..... 10-2020-0017294

(51) Int. Cl.
*F25B 39/00* (2006.01)
*F25B 39/02* (2006.01)

(52) U.S. Cl.
CPC ..... *F25B 39/00* (2013.01); *F25B 39/028* (2013.01); *F25B 2339/0242* (2013.01)

(58) Field of Classification Search
CPC . F25B 39/00; F25B 39/028; F25B 2339/0242
USPC ..... 62/518
See application file for complete search history.

(56) References Cited

U.S. PATENT DOCUMENTS

| | | | |
|---|---|---|---|
| 1,760,907 | A | 6/1930 | Jones |
| 6,167,713 | B1 | 1/2001 | Hartfield |
| 6,253,571 | B1 | 7/2001 | Fujii |
| 6,868,695 | B1 | 3/2005 | Dingel |
| 8,434,226 | B2 | 5/2013 | Niitsuma |

(Continued)

FOREIGN PATENT DOCUMENTS

| | | |
|---|---|---|
| CN | 101382359 | 3/2009 |
| CN | 201983533 | 9/2011 |

(Continued)

OTHER PUBLICATIONS

Korean Notice of Allowance dated Jun. 21, 2021 issued in Application No. 10-2020-0017294.

(Continued)

*Primary Examiner* — Len Tran
*Assistant Examiner* — Kamran Tavakoldavani
(74) *Attorney, Agent, or Firm* — KED & Associates

(57) ABSTRACT

An evaporator including a housing with a refrigerant inlet and a refrigerant outlet; heat transfer tubes contained in the housing, in which chilled water for heat exchange with refrigerant inside of the housing flows; at least one distribution tray placed apart from the heat transfer tubes and having a plurality of holes for distributing refrigerant over the underlying heat transfer tubes; a vapor-liquid separator that is placed above the distribution tray and separates an introduced mixed refrigerant into vapor refrigerant and liquid refrigerant and distributes the liquid refrigerant to the distribution tray; and at least one tube support with a plurality of holes for passing the heat transfer tubes through, that is placed inside of the housing and supports the distribution tray.

13 Claims, 14 Drawing Sheets

(56) References Cited

U.S. PATENT DOCUMENTS

| | | | | |
|---|---|---|---|---|
| 8,863,551 | B2 | 10/2014 | De Larminat | |
| 9,810,458 | B2 | 11/2017 | Hattori | |
| 10,132,537 | B1 | 11/2018 | Stamp | |
| 2004/0112573 | A1 | 6/2004 | Moeykens | |
| 2004/0256088 | A1 | 12/2004 | Ayub | |
| 2007/0151279 | A1 | 7/2007 | Liu | |
| 2008/0148767 | A1 | 6/2008 | De Larminat | |
| 2008/0149311 | A1 | 6/2008 | Liu et al. | |
| 2008/0163637 | A1* | 7/2008 | Ring | F28F 9/0265 62/304 |
| 2009/0178790 | A1 | 7/2009 | Schreiber | |
| 2010/0107676 | A1 | 5/2010 | Liu | |
| 2010/0132927 | A1 | 6/2010 | Benetton | |
| 2010/0276130 | A1 | 11/2010 | De Larminat | |
| 2010/0326108 | A1 | 12/2010 | Schreiber | |
| 2011/0017432 | A1 | 1/2011 | Kulankara | |
| 2011/0226005 | A1 | 9/2011 | Lee | |
| 2013/0277018 | A1 | 10/2013 | Numata | |
| 2013/0277019 | A1 | 10/2013 | Numata | |
| 2014/0284032 | A1 | 9/2014 | Gentry | |
| 2015/0013950 | A1 | 1/2015 | Numata | |
| 2015/0013951 | A1* | 1/2015 | Numata | F28D 7/16 165/157 |
| 2016/0040917 | A1 | 2/2016 | Liue | |
| 2016/0109182 | A1 | 4/2016 | Xu | |
| 2016/0123673 | A1 | 5/2016 | Alahyari | |
| 2016/0146518 | A1 | 5/2016 | Liu | |
| 2016/0201991 | A1 | 7/2016 | Esformes | |
| 2016/0320136 | A1 | 11/2016 | Christians | |
| 2016/0341457 | A1 | 11/2016 | Christians | |
| 2017/0138652 | A1 | 5/2017 | Hattori | |
| 2017/0153061 | A1 | 6/2017 | Yoshioka | |
| 2017/0254573 | A1 | 9/2017 | Numata | |
| 2018/0299172 | A1 | 10/2018 | Hartfield | |
| 2020/0056817 | A1 | 2/2020 | Huang | |
| 2020/0200478 | A1 | 6/2020 | Wilson | |
| 2020/0200480 | A1* | 6/2020 | Wilson | F25B 39/028 |
| 2020/0340721 | A1 | 10/2020 | Guo | |
| 2021/0254871 | A1 | 8/2021 | Kang | |
| 2021/0254872 | A1 | 8/2021 | Kang | |
| 2021/0254873 | A1 | 8/2021 | Kang | |
| 2021/0285701 | A1 | 9/2021 | Cheng | |

FOREIGN PATENT DOCUMENTS

| | | |
|---|---|---|
| CN | 102914097 | 2/2013 |
| CN | 103062962 | 4/2013 |
| CN | 103851834 | 6/2014 |
| CN | 104949397 | 9/2015 |
| CN | 105135755 | 12/2015 |
| CN | 106123400 | 11/2016 |
| CN | 106369888 | 2/2017 |
| CN | 106482400 | 3/2017 |
| CN | 106524599 | 3/2017 |
| CN | 107270590 | 10/2017 |
| CN | 108709339 | 10/2018 |
| CN | 108779943 | 11/2018 |
| CN | 208652987 | 3/2019 |
| CN | 110662936 | 1/2020 |
| EP | 1 636 528 | 3/2006 |
| JP | H 03-211391 | 9/1991 |
| JP | 2007-309604 | 11/2007 |
| JP | 2009-275967 | 11/2009 |
| JP | 2015-190733 | 11/2015 |
| JP | 2016-525206 | 8/2016 |
| KR | 10-2000-0076283 | 12/2000 |
| KR | 10-2002-0077361 | 10/2002 |
| KR | 20-2011-0009739 | 10/2011 |
| KR | 10-2014-0069996 | 6/2014 |
| KR | 10-2014-0073124 | 6/2014 |
| KR | 10-2015-0004793 | 1/2015 |
| KR | 10-2017-0114320 | 10/2017 |

OTHER PUBLICATIONS

Chinese Notice of Allowance issued in Application No. 202110182068.6 dated Nov. 9, 2022.

* cited by examiner

EVAPORATOR

CROSS-REFERENCE TO RELATED APPLICATION(S)

This application claims priority under 35 U.S.C. § 119 to Korean Application No. 10-2020-0017294 filed on Feb. 13, 2020, whose entire disclosure is hereby incorporated by reference.

BACKGROUND OF THE DISCLOSURE

Field of the Disclosure

The present disclosure relates to an evaporator, and more particularly, to a chiller system.

Related Art

Generally, a chiller is a machine that supplies chilled water to a place of need for chilled water, which cools the chilled water by heat exchange between a refrigerant circulating through a refrigeration system and chilled water circulating between the place of need for chilled water and the refrigeration system. Chillers, which are large-capacity equipment, can be installed in large-size buildings or the like.

FIG. 1 is a view showing a chiller system.

Referring to FIG. 1, a conventional chiller system 1 comprises a chiller unit and a place 6 of need. The place 6 of need may be understood as an air conditioning apparatus using chilled water.

The chiller unit comprises a compressor 2 for compressing refrigerant, a condenser 3 for condensing the refrigerant compressed by the compressor 2, an expansion device 4 for reducing the pressure of the refrigerant condensed by the condenser 3, and an evaporator 5 for evaporating the refrigerant whose pressure is reduced by the expansion device 4.

Refrigerant exchanges heat with outside air in the condenser 3 and exchanges heat with chilled water in the evaporator 5.

The chiller system 1 comprises chilled water piping 8 which guides the circulation of chilled water by connecting the evaporator 5 and the place of need 6 and a pump 7 provided in the chilled water piping 8 to force chilled water to flow.

When the pump 7 is operated, chilled water can flow from the place 6 of need to the evaporator 7 or from the evaporator 5 to the place 6 of need, via the chilled water piping 8.

The evaporator 5 has a refrigerant flow path 5*a* through which refrigerant flows and a chilled water flow path 5*b* through which chilled water flows. The chilled water flow path 5*b* is formed by heat transfer tubes, and heat exchange can occur between the refrigerant and the chilled water as the refrigerant comes into contact with the heat transfer tubes.

Such an evaporator 5 may be classified as a dry expansion type evaporator, a flooded type evaporator, a falling film type evaporator, etc., depending on its internal state.

The dry expansion type evaporator is an evaporator 10 that performs heat exchange by introducing a refrigerant passed directly into the evaporator 10 through the expansion device and fully evaporating the refrigerant inside the evaporator 10. The dry expansion type evaporator requires less refrigerant but has lower efficiency than the flooded type evaporator.

The flooded type evaporator is an evaporator 10 with a liquid refrigerant entrapped in a lower part of it, in which heat exchange occurs between liquid refrigerant and chilled water as the liquid refrigerant is evaporated by means of heat transfer tubes immersed in the liquid refrigerant.

The dry expansion type evaporator, in comparison to the dry expansion type evaporator, has better efficiency but requires an enormous amount of refrigerant, is costly to manufacture, and is limited in heat transfer capability because its heat transfer mechanism works by boiling flooded refrigerant.

In contrast, the falling film type evaporator is an evaporator 10 that forms a refrigerant liquid film when a liquid refrigerant falls onto the heat transfer tubes through a distribution unit and that performs heat exchange as the refrigerant liquid film evaporates.

The failing film type evaporator has higher thermal conductivity than the flooded type evaporator since the liquid refrigerant evaporates the liquid film formed on the heat transfer tubes, and therefore can remarkably reduce the amount of refrigerant required and the number of heat transfer tubes and has equal heat-transfer performance to the flooded type evaporator.

Meanwhile, despite its superior performance, there are several problems to be solved with such falling film type evaporators. Thus, most of the currently used falling film type evaporators are not full falling film type but partial falling film type (in which heat exchange in an upper part occurs in the same way as in falling film type evaporators and heat exchange in a lower part occurs in the same way as in flooded type evaporators).

One of these problems is that dry-out points (points on the heat transfer tubes where a film of liquid refrigerant is not formed) are formed on the heat transfer tubes and therefore increases the area of the heat transfer tubes where heat exchanges does not occur, causing deterioration of heat exchange performance across the entire chiller system. The dry-out points are formed due to the following causes:

Firstly, in the case of the falling film type evaporator, as opposed to the dry expansion type evaporator or flooded type evaporator, if a structure such as a distribution unit for distributing liquid refrigerant is slanted, the liquid refrigerant collects on one side and is therefore unevenly distributed over the heat transfer tubes, thus forming dry-out points.

To prevent this problem, it is essential to distribute liquid refrigerant evenly over the heat transfer tubes. Also, one of the important issues to be solved to make an ideal falling film type evaporator is to keep structural components such as the distribution unit, the heat transfer tubes, and a vapor-liquid separator horizontal to one another.

Secondly, in a case where a mixed refrigerant discharged from the expansion device 4 is distributed over the heat transfer tubes without being separated or unless the flow rate of refrigerant, which is quite high due to the suction force of the compressor 2, is decreased, vapor refrigerant and liquid refrigerant are all mixed up, causing an uneven distribution of the liquid refrigerant over the heat transfer tubes and forming dry-out points. Moreover, the liquid refrigerant carried over in the vapor refrigerant may be introduced into the compressor 2 and therefore cause a failure of the chiller system.

In this case, the stagnation pressure is quite high due to the flow rate of refrigerant. Thus, the stagnation pressure of refrigerant may deform the structure of the distribution unit when the evaporator is run for a long time. The possibility of deformation is much higher in a distribution unit formed in a similar way to a tray made of a thin steel plate. Accordingly, structural stability needs to be taken into consideration as well.

Thirdly, when vapor refrigerant evaporated from the heat transfer tubes flows, falling liquid refrigerant is dispersed on the outside of the heat transfer tubes and forms dry-out points on the heat transfer tubes. This phenomenon becomes more severe especially on the heat transfer tubes positioned in the lower part than those positioned in the upper part.

In this case, as pointed out in the first cause, the liquid refrigerant may be carried over in the vapor refrigerant.

However, it is tricky to take structural stability into consideration while reducing dry-out points by keeping the structural components horizontal to one another.

Most of all, since evaporators are usually quite long, typically 2 m to 4 m, the structural components used inside the evaporator 10 of the chiller system 1 are fairly large in size and weight. Thus, it is practically difficult to insert many different structural components horizontally into the evaporator 10 and weld them while keeping them horizontal to one another Besides, the larger the area to be welded to improve structural stability, the more the structural components become distorted due to thermal deformation in the process of mounting the distribution unit.

Another consideration is that the vapor-liquid separator also may be mounted at the evaporator to separate the mixed refrigerant into the vapor refrigerant and the liquid refrigerant and distribute them separately. However, the more devices connected, the more difficult it becomes to keep the structural components horizontal to one another while taking structural stability into consideration.

This work makes the manufacturing process complicated and requires considerable efforts from welders and various facilities, which leads directly to a rise in manufacturing costs.

In spite of the above problems, prior art technologies—for example, Korean Laid-Open Patent Publication No. 10-2017-0114320 and U.S. Laid-Open Patent Publication No. US2008/0149311—only give descriptions of the configuration and shape for implementing the functions of the components but do not provide disclosure of structural problems associated with keeping the distribution unit and other structural components horizontal to one another or practical problems with the installation process.

PRIOR ART DOCUMENTS

Patent Documents

Korean Laid-Open Patent Publication 10-2017-0114320
U.S. Laid-Open Patent Publication US 2008/0149311

SUMMARY OF THE DISCLOSURE

The present disclosure provides a support structure that helps keep a distribution tray, a vapor-liquid separator, etc. horizontal and stable.

The present disclosure also provides a structure that simplifies the process of installing structural components inside an evaporator.

The aspects of the present disclosure are not limited to the foregoing, and other aspects not mentioned herein will be able to be clearly understood to those skilled in the art from the following description.

An exemplary embodiment of the present disclosure provides an evaporator comprising: a housing with a refrigerant inlet and a refrigerant outlet; heat transfer tubes that are contained in the housing, in which chilled water for heat exchange with refrigerant inside the housing flows; at least one distribution tray that is placed apart from the heat transfer tubes and has a plurality of holes for distributing refrigerant over the underlying heat transfer tubes; a vapor-liquid separator that is placed above the distribution tray and separates an introduced mixed refrigerant into a vapor refrigerant and a liquid refrigerant and distributes the liquid refrigerant to the distribution tray; and a tube support with a plurality of holes for passing the heat transfer tubes through, that is placed inside the housing and supports the distribution tray.

The evaporator may further comprise a pair of support frames that are fixed to either side of the width direction of the housing.

The vapor-liquid separator may comprise a plurality of side arms that are arranged in the length direction of the vapor-liquid separator and supported by the support frame.

The support frames may comprise rail rods that are formed lengthways in the length direction of the vapor-liquid separator so as to support the plurality of side arms and guide the insertion of the vapor-liquid separator.

The support frames may comprise a plurality of first brackets that are connected to the rail rods and fixed to the housing.

The evaporator may further comprise a bridge rod attached to the ends of the distribution tray and the ends of the housing, wherein at least one of the plurality of first brackets is attached to the bridge rod.

The support frames may further comprise a plurality of second brackets that are fixed to the top of the tube support and connected to the rail rods.

The plurality of side arms may be bent at portions that make contact with the rail rods.

The tube support may comprise upper guides that protrude to the left and right from the top of the tube support, respectively, form a space where the insertion of the distribution tray is guided, and supports the distribution tray.

The evaporator may further comprise lateral rods that are formed lengthways in the length direction of the distribution tray and attached to the sidewalls of the distribution tray and are supported by the upper guides.

The tube support may have a slit in which one of the at least one distribution tray is inserted.

The tube support may comprise lower guides that protrude inward from the side of the slit, support the lateral rods protruding from the sidewalls of the distribution tray, and guide the insertion of the distribution tray.

The distribution tray may have an insertion opening that is recessed on the top so that at least part of an upper portion of the tube support is inserted therein to support the distribution tray.

Specific details of other embodiments are included in the detailed description and the drawings.

BRIEF DESCRIPTION OF THE DRAWINGS

FIG. 5 is a plan view of the distribution tray 40 of FIG. 2 when viewed from above, and FIG. 6 is a perspective view showing the underside of the distribution tray 40 of FIG. 2.

DESCRIPTION OF EXEMPLARY EMBODIMENTS

Figure 1:
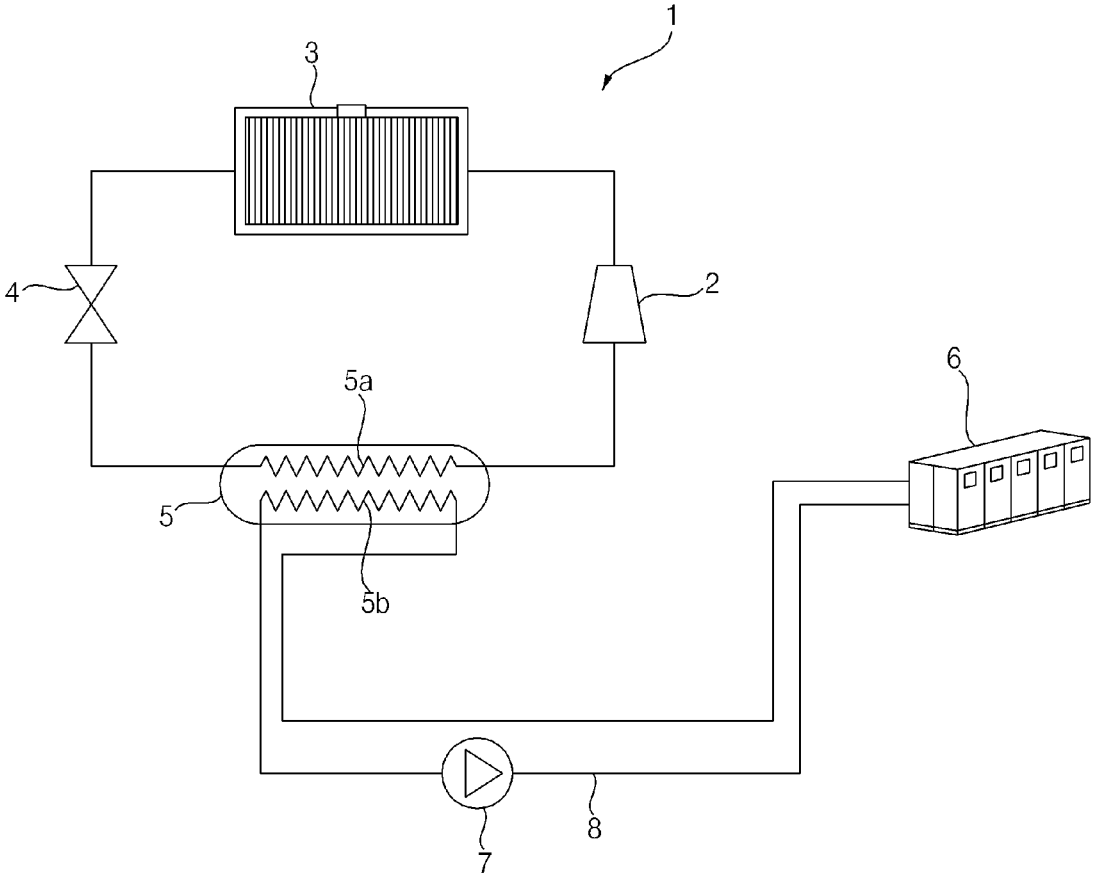
FIG. 1 is a view showing a chiller system.

Advantages and features of the present disclosure and methods for achieving them will be made clear from the embodiments described below in detail with reference to the accompanying drawings. The present disclosure may, however, be embodied in many different forms, and should not be construed as being limited to the embodiments set forth herein. Rather, these embodiments are provided so that this disclosure will be thorough and complete, and will fully convey the scope of the present disclosure to those skilled in the art. The present disclosure is merely defined by the scope of the claims. Like reference numerals refer to like elements throughout the specification.

Spatially relative terms such as "below", "beneath", "lower", "above", or "upper" may be used herein to describe one element's relationship to another element as illustrated in the figures. It will be understood that such spatially relative terms are intended to encompass different orientations of the device in addition to the orientation depicted in the figures. For example, if a component in the figures is turned over, elements described as "below" or "beneath" other elements would then be oriented "above" the other elements. The exemplary terms "below" or "beneath" can, therefore, encompass both positional relationships of above and below. Since the component may be oriented in another direction, spatially relative terms may be interpreted in accordance with the orientation.

The terminology used in the present disclosure is for the purpose of describing particular embodiments only, and is not intended to limit the disclosure. As used in the disclosure and the appended claims, the singular forms "a", "an", and "the" are intended to include the plural forms as well, unless the context clearly indicates otherwise. It will be further understood that the terms "comprises" and/or "comprising", when used in this specification, specify the presence of stated components, steps, and/or operations, but do not preclude the presence or addition of one or more other components, steps, and/or operations.

Unless otherwise defined, all terms (including technical and scientific terms) used herein have the same meanings as those commonly understood by one of ordinary skill in the art. It will be further understood that terms such as those defined in commonly used dictionaries should be interpreted as having meanings consistent with their meanings in the context of the relevant art and the present disclosure, and are not to be interpreted in an idealized or overly formal sense unless expressly so defined herein.

In the drawings, the thickness or size of each element may be exaggerated, omitted, or schematically illustrated for convenience of description and clarity. Also, the size or area of each element may not entirely reflect the actual size thereof.

Hereinafter, the present disclosure will be described with reference to the drawings for explaining an evaporator according to embodiments of the present disclosure.

Figure 2:
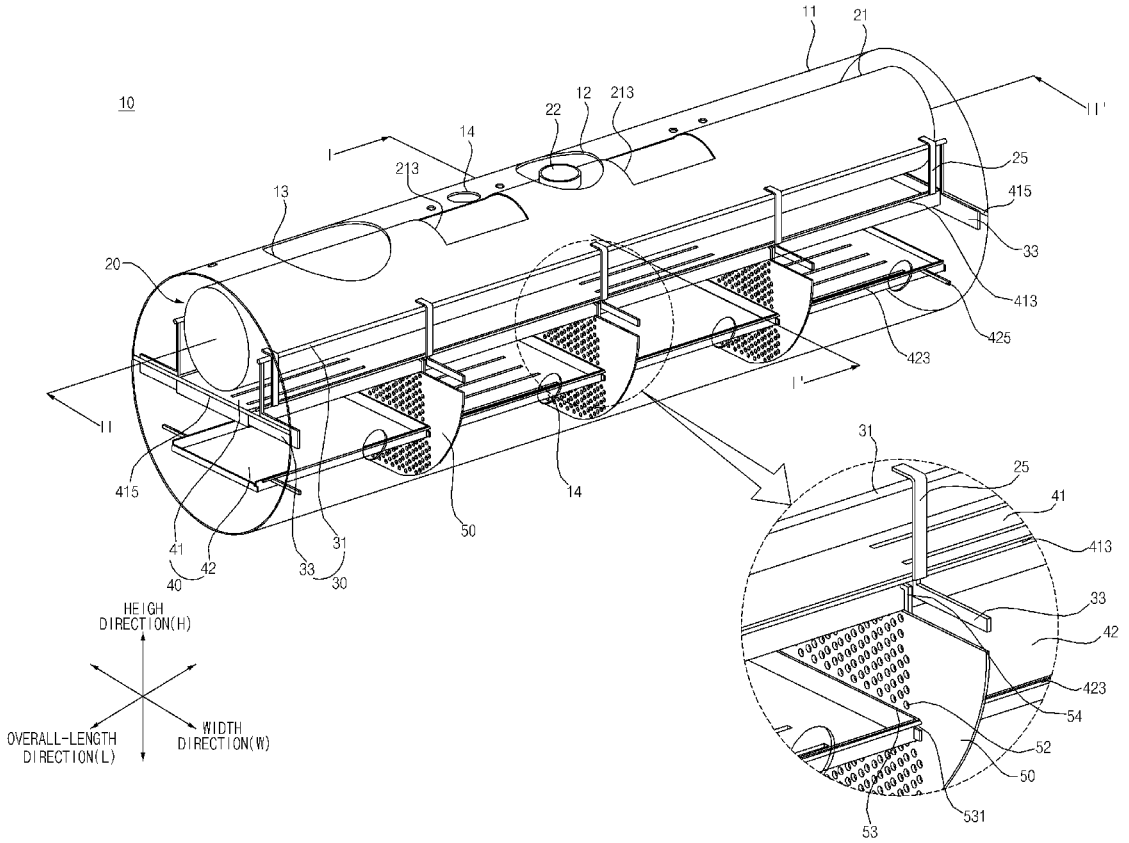
FIG. 2 is a perspective view of an evaporator according to an exemplary embodiment of the present disclosure.
Figure 12:
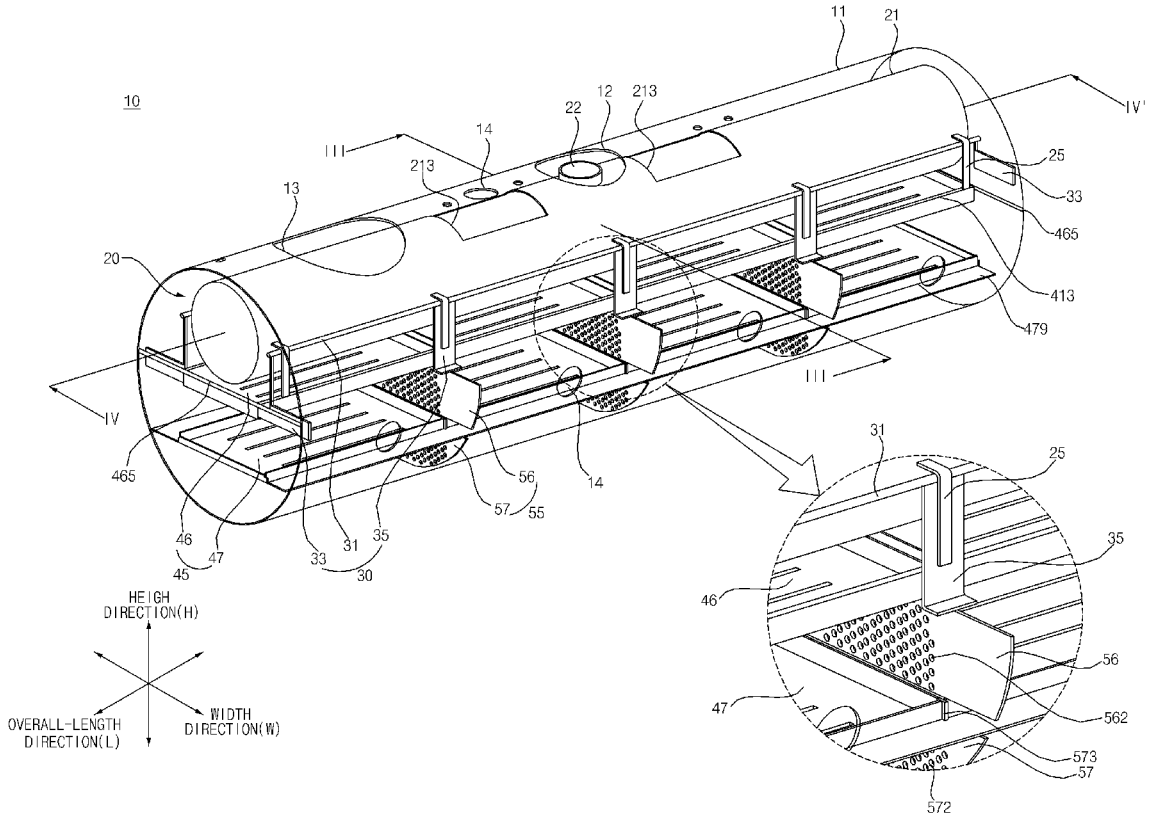
FIG. 12 is a perspective of an evaporator according to another exemplary embodiment of the present disclosure.

Referring to FIG. 2 and FIG. 12, for example, the length direction L relative to a cylindrical housing 11 may refer to a direction in which the length from one side of the housing 11 to the other side is measured, the width direction W may refer to a direction in which the diameter of a cross-section of the housing 11 is horizontally measured from the ground, and the height direction H may refer to a direction in which the diameter of a cross-section of the housing 11 is vertically measured from the ground.

FIGS. 2 to 11 are views for illustrating the structure and workings of an evaporator according to an exemplary embodiment of the present disclosure.

Figure 3:
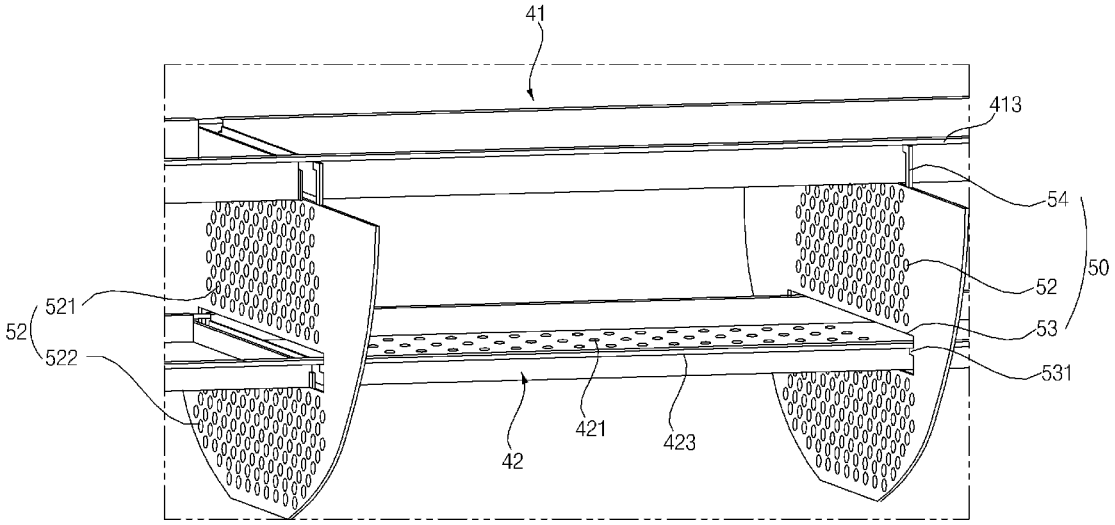
FIG. 3 is an enlarged perspective view depicting part of FIG. 2.
Figure 4:
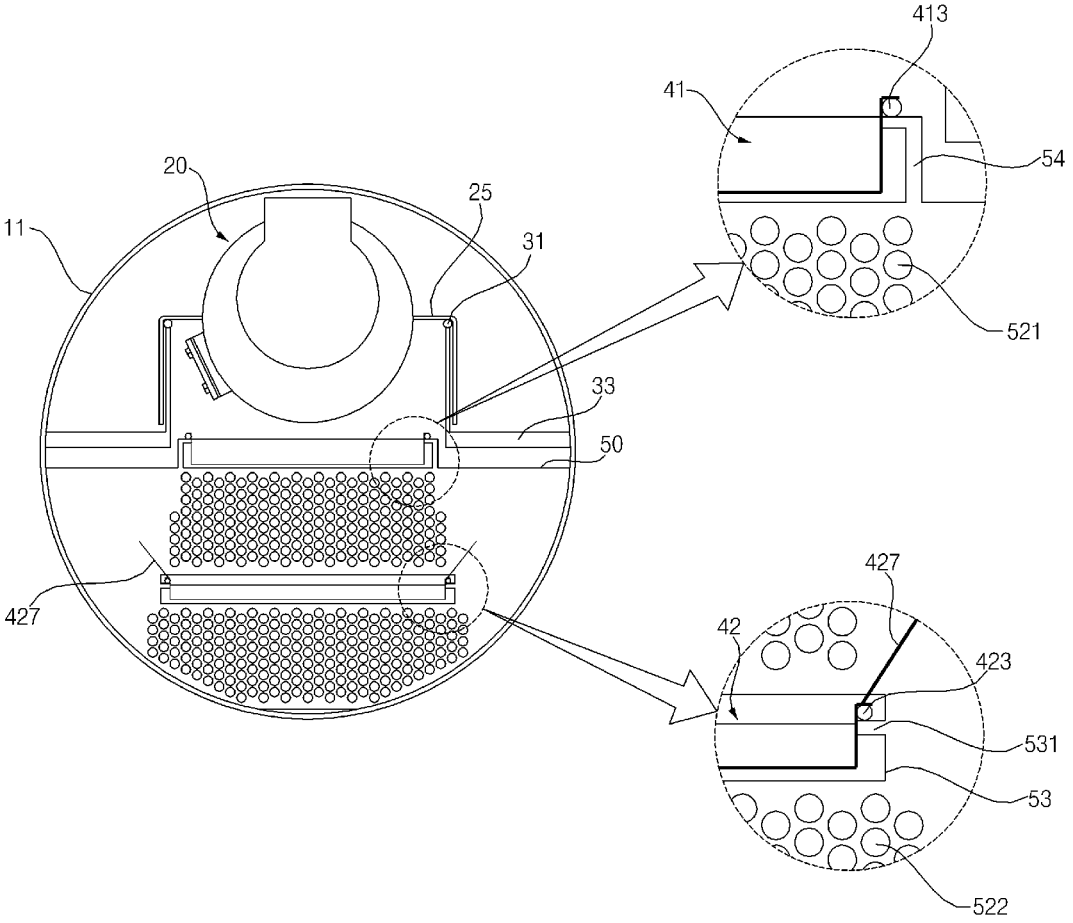
FIG. 4 is a cross-sectional view taken along the line I-I' of FIG. 2.

In FIGS. 2 to 4, the structure and workings of an evaporator according to an exemplary embodiment of the present disclosure will be illustrated.

Referring to FIGS. 2 to 4, an evaporator 10 comprises a housing 11, heat transfer tubes P, and a distribution tray 40.

The housing 11 has a refrigerant inlet 12 and a refrigerant outlet 13.

Refrigerant discharged from an expansion device 4 is a mixed refrigerant of vapor refrigerant and liquid refrigerant. The mixed refrigerant is introduced into the evaporator 10 through the refrigerant inlet 12. Of the introduced mixed refrigerant, the vapor refrigerant is released to the compressor 2 through the refrigerant outlet 13. The liquid refrigerant evaporates after heat exchange and changes its phase to a vapor phase, and is then released to the compressor through the refrigerant outlet 13.

The housing contains heat transfer tubes P in which chilled water used for heat exchange with the refrigerant inside the housing flows.

The liquid refrigerant forms a liquid film by coming into contact with the surfaces of the heat transfer tubes P. The chilled water flowing within the heat transfer tubes P becomes cooler because its heat is taken away by the liquid refrigerant, and heat exchange occurs in such a way that the liquid refrigerant vaporizes by absorbing heat from the chilled water. The heat transfer tubes P are usually composed of a bundle of heat transfer tubes P comprising a plurality of heat transfer tubes P.

The distribution tray 40 distributes refrigerant over the heat transfer tubes placed under it. The distribution tray 40 may distribute refrigerant over the heat transfer tubes via a plurality of holes formed therein. The distribution tray 40 may be placed apart from the heat transfer tubes P.

The distribution tray 40 may be formed lengthways in the length direction of the housing 11. The distribution tray 40 may be shaped in such a manner as to contain liquid refrigerant and make the liquid refrigerant fall and distribute it.

For example, the distribution tray 40 may have the shape of a tray with a plurality of holes formed in the bottom surface. The distribution tray 40 may form sidewalls on either side of the width direction W. The distribution tray 40 may form sidewalls on either side of the length direction L. Unless defined otherwise, sidewalls of the distribution tray 40 may refer to sidewalls formed on either side of the width direction W of the distribution tray 40.

If a single distribution tray 40 is used for a large number of heat transfer tubes P, more dry-out points are formed on the heat transfer tubes P positioned in the lower part than those positioned in the upper part, which may lead to deterioration of heat exchange performance.

Accordingly, at least one distribution tray 40 may be mounted. For example, the distribution tray 40 may comprise a first distribution tray 41 and a second distribution tray 42 positioned under the first distribution tray 41.

The heat transfer tubes P may be placed in a lower part of the first distribution tray 41 and in a lower part of the second distribution tray 42. The heat transfer tubes P may be placed between the lower part of the first distribution tray 41 and the lower part of the second distribution tray 42. In this case, the heat transfer tubes P may comprise upper heat transfer tubes P1 placed in the upper part of the second distribution tray 42 and lower heat transfer tubes P2 placed in the lower part of the second distribution tray 42.

The first distribution tray 41 may be placed at a distance above the tops of the upper heat transfer tubes P1. The first distribution tray 41 may distribute refrigerant over the upper heat transfer tubes P1 placed below it.

The second distribution tray 42 is placed between the bottoms of the upper heat transfer tubes P1 and the tops of the lower heat transfer tubes P2. The second distribution tray 42 may be placed at a distance above the tops of the lower heat transfer tubes P2. The second distribution tray 42 may distribute refrigerant over the lower heat transfer tubes P2 placed below it.

To prevent the liquid refrigerant falling from the distribution tray 40 from veering to the outside of the heat transfer tubes P due to the vapor refrigerant evaporated from the heat transfer tubes P, the length of the bundle of heat transfer tubes P along the width direction W may be greater than the length of the distribution tray 40 along the width direction W. That is, the length between the heat transfer tubes P placed on the outermost side of the bundle of heat transfer tubes P may be greater than the length of the distribution tray 40 along the width direction W.

The length of the bundle of the upper heat transfer tubes P1 placed below the first distribution tray 41 along the width direction W may be greater than the length of the first distribution tray 41 along the width direction W. The length of the bundle of lower heat transfer tubes P2 placed below the second distribution tray 42 along the width direction W may be greater than the length of the second distribution tray 42 along the width direction W.

The evaporator 10 may further comprise a vapor-liquid separator 20 for separating the mixed refrigerant introduced from the expansion device 4 into a vapor refrigerant and a liquid refrigerant. The vapor-liquid separator 20 may be placed above the distribution tray 40.

The vapor-liquid separator 20 may be placed apart from the bottom of the distribution tray 40. The vapor-liquid separator 20 may be placed inside the housing 11. The vapor-liquid separator 20 may be positioned outside the housing 11 depending on the characteristics of the evaporator 10.

The vapor-liquid separator 20 may separate the mixed refrigerant. The vapor-liquid separator 20 distributes the separated liquid refrigerant to the distribution tray 40. The separated vapor refrigerant is released out of the evaporator 10 through the refrigerant outlet 13 by a suction force generated by the compressor 2.

The vapor-liquid separator 20 may comprise a chamber that has an inlet port 22 communicating with the refrigerant inlet 12, a vapor refrigerant exit 213 communicating with the refrigerant outlet 13, and a plurality of holes 211 formed in the bottom.

The chamber 21 may form the exterior of the vapor-liquid separator 20. A cross-section of the chamber 21 may be in the shape of a circular or polygonal tube.

The mixed refrigerant may be introduced into the chamber 21 through the inlet port 22. The introduced refrigerant is separated into a vapor refrigerant and a liquid refrigerant. The chamber 21 may distribute the separated liquid refrigerant to the distribution tray 40 via the plurality of holes formed in the bottom. The separated vapor refrigerant is released to the refrigerant outlet 13 through the vapor refrigerant exit 213 formed on the chamber 21. The vapor refrigerant exit 213 may be formed in an upper part of the chamber 21.

A stabilizer may be mounted inside the chamber 21 to decrease the flow rate of refrigerant. This will be described later.

The evaporator 10 may further comprise a tube support 50 with a plurality of holes 52 through which the heat transfer tubes P are passed. The tube support 50 may be placed inside the housing 11 and support the distribution tray 40.

At least one tube support 50 may be placed inside the housing 11. Preferably, a plurality of tube supports 50 may be arranged inside the housing 11. In this case, the plurality of tube supports 50 may be arranged at intervals in the length direction L of the housing 11. The tube supports 50 may be arranged in such a way that their tops are on the same level.

The tube supports 50 may be attached to the inner surface of the housing 11. At least part of the sides of the tube supports 50 may contact with the inner surface of the housing 11. Preferably, part of the periphery of the tube supports 50 may contact with the contour of the inner periphery of the housing 11 and be primarily fixed by welding.

The plurality of heat transfer tubes P may be inserted through the plurality of holes 52. The tube supports 50 may be secondarily fixed by means of the heat transfer tubes P passed through the plurality of holes 52.

The tops of the tube supports 50 may make contact with the bottom surface of the distribution tray 40 and support the distribution tray 40. To horizontally support the distribution tray 40, the tops of the tube supports 50 may be shaped in such a way as to contact with the bottom surface of the distribution tray 40. For example, the top surfaces of the tube supports 50 contacting the flat bottom surface of the distribution tray 40 may be flat.

Meanwhile, the tube supports 40 may horizontally support the distribution tray 40 by means of a support structure protruding from the top. This will be described later.

In the case where a single tube support 50 is placed, the heat transfer tubes P may be passed through the plurality of holes 52 formed in the tube supports 50 and fixed to either side of the length direction L of the housing 11.

The single tube support 50 may support the center of the bottom surface of the distribution tray 40. A supplementary support structure such as a bridge rod 415 may be attached to either side of the length direction L of the distribution tray 40 and support the distribution tray 40 in a more uniform and stable manner. This will be described later.

In the case where a plurality of tube supports 50 are arranged, the heat transfer tubes P are passed through the same spot of the plurality of holes 52 formed in the tube supports 50, so that the tube supports 50 are arranged horizontally to one another when they are fixed. Accordingly, the tube supports 50 may support the distribution tray 40 horizontally and stably.

The evaporator 10 may further comprise a pair of support frames 30 that are fixed to either side of the width direction W of the housing 11.

The support frames 30 may protrude into the housing 11 from either side of the width direction W of the housing 11. The support frames 30 may be at the same height on either side of the width direction W of the housing 11. The support frames 30 may horizontally support the vapor-liquid separator 20 by coming into contact with at least part of the periphery of the vapor-liquid separator 20.

If the vapor-liquid separator 20 is not horizontally placed, the separated liquid refrigerant may collect on one side and therefore unevenly distributed over the distribution tray 40. This problem may be avoided by the support frames 30 horizontally supporting the vapor-liquid separator 20.

The support frames 30 may allow the vapor-liquid separator 20 to be placed at a distance above the bottom of the distribution tray 40.

If the vapor-liquid separator 20 is not placed at a distance from the distribution tray 40, the liquid refrigerant cannot be evenly distributed over the entire distribution tray 40 due to the surface tension of the liquid refrigerant. Accordingly, it is desirable that the distribution tray 40 and the vapor-liquid separator 20 are horizontally spaced apart from each other so that the liquid refrigerant is evenly distributed over the distribution tray. 40.

The vapor-liquid separator 20 may comprise a plurality of side arms 25 on either side of the width direction W of the vapor-liquid separator 20, that are arranged in the length direction L of the vapor-liquid separator 20 and supported by the support frames 30.

The side arms 25 may be formed on either side of the chamber 21 of the vapor-liquid separator 20. The side arms 25 may be arranged in the length direction L of the chamber 21 and supported by the support frames 30.

The plurality of side arms 25 may comprise portions that protrude horizontally from either side of the width direction W of the vapor-liquid separator 20. The side arms 25 may have an inverted "L" shape.

The plurality of side arms 25 on one side may be spaced at regular intervals along the length direction of the vapor-liquid separator 20. The axis along the length direction L of the vapor-liquid separator 20 and a continuous surface connecting the plurality of side arms 25 arranged on one side may be parallel to each other. The plurality of side arms 25 may be at the same height from the ground.

The vapor-liquid separator 20 may be kept horizontal as the plurality of side arms 25 arranged on either side are horizontally supported by the support frames 30. The side arms 25 may distribute the stagnation pressure of refrigerant exerted on the vapor-liquid separator 20 over the support frames 30.

The support frames 30 may comprise rail rods 31 that are formed lengthways in the length direction of the vapor-liquid separator 20 so as to support the plurality of side arms 25 and guide the insertion of the vapor-liquid separator 20. The rail rods 31 may be formed in the shape of a pipe.

The rail rods 31 may be mounted on either side of the width direction W inside the housing 11. The rail rods 31 may be placed parallel to the central axis of the vapor-liquid separator 20. The rail rods 31 on either side may be at the same height from the ground.

The rail rods 31 on one side may come into contact with the bottoms of the plurality of side arms 24 on one side and support the side arms 25. The rail rods 31 may receive a load from the side arms 25 and distribute it and support the vapor-liquid separator 20 horizontally.

When mounting the vapor-liquid separator 20 within the housing 11, the rail rods 31 guide the insertion of the vapor-liquid separator 20 into the housing 11. At this point, the vapor-liquid separator 20 may be pushed into the housing 11 from one side of the housing 11, with the side arms 25 of the vapor-liquid separator 20 hung on the rail rods 31, which reduces the number of steps in the welding process and greatly simplifies the installation process.

The evaporator 10 may comprise a plurality of first brackets 33 that are connected to the rail rods 31 and fixed to the housing 11.

The first brackets 33 may comprise portions that protrude inward from either side of the width direction W of the housing 11. The first brackets 33 may be formed in an "L"-shape.

The plurality of first brackets 33 may comprise portions that make contact with the rail rods 31, respectively. The plurality of first brackets 33 on one side may be arranged at intervals along the length direction L of the rail roads 31. The plurality of first brackets 33 may be formed in such a way that the portions contacting the rail rods 31 are at the same height from the ground.

The first brackets 33 may support the rail rods 31. The first brackets 33 may be fixed to the housing 11 and endure the shear force transmitted from the rail rods 31.

The evaporator 11 may further comprise a bridge rod 415 attached to the ends of the distribution tray 40 and the ends of the housing 11. At least one of the plurality of the first brackets 33 may be attached to the bridge rod 415. The end portions refer to at least one side of the length direction L of the distribution tray 40 and housing 11.

The bridge rod 415 may be formed lengthways in the width direction W. A middle part of the bridge rod 415 may be attached to the ends of the distribution tray 40. Opposite ends of the bridge rod 415 may be fixed to the ends of the housing 11 and support the end of the distribution tray 40.

The plurality of side arms 25 may be bent downward at portions that make contact with the rail rods 31.

In this case, when the vapor-liquid separator 20 is inserted into the housing 11, the bent portions of the plurality of side arms 25 are hung on the rail rods 31, thereby guiding the vapor-liquid separator 20 in the correct direction.

The first distribution tray 41 may be supported by the top of the tube support 50 and placed at a distance above the tops of the heat transfer tubes P and distributes refrigerant over the underlying heat transfer tubes P.

The tube support 50 may comprise upper guides 54 that protrude upward from the top of the tube support 50 and guide the insertion of the distribution tray 40. The distribution tray 40 may be a first distribution tray 41.

The upper guides 54 may be formed adjacent to the sidewalls formed on either side of the width direction W of the distribution tray 40. The upper guides 54 may protrude to the left and right sides of the distribution tray 40, respectively, and form a space where the distribution tray 40 is inserted. The upper guides 54 may have an inverted "L" shape.

The upper guides 54 may support the distribution tray 40. For example, the upper guides 54 may support both sides of the bottom of the distribution tray 40. In another example, the upper guides 54 may support portions that are bent outward from the sidewalls of the distribution tray 40.

When mounting the distribution tray 40 within the housing 11, the upper guides 54 guide the insertion of the distribution tray 40 into the housing 11. At this point, the distribution tray 40 is positioned between the upper guides 54, and the distribution tray 40 is seated on the upper side of the tube support 50 or hung on the upper guides 54 on either side. Afterwards, when the distribution tray 40 is pushed in the length direction of the housing 11, the upper guides 54 guide the insertion of the distribution tray 40, thereby greatly simplifying the installation process.

Moreover, by inserting the distribution tray 40 through the upper guides formed on the plurality of horizontally arranged tube supports 50, the distribution tray 40 may be guided into a more correct position and supported more stably.

When the bottom of the distribution tray 40 is perforated with a plurality of holes 411 and 421, burrs (raised edges remaining on metal after it has been cut) may be formed downward from the bottom of the distribution tray 40. The burrs may be caught on the top surface of the tube support 50 when the distribution tray 40 is inserted.

In another example, when the bottom of the distribution tray 40 is cut and bent downward to form the holes, tips 4111 and 4211 may be caught on the top surface of the tube support 50.

Accordingly, to avoid this problem, the distribution tray 40 guided by the upper guides 54 may be placed at a distance above the top surface of the tube support 50 positioned between the upper guides 54. For example, it is desirable that the distribution tray 40 be placed about 5 mm apart from the top surface of the tube support 50 so as to keep the top surface of the tube support 50 from making contact with the burrs or tips 4111 and 4211.

The evaporator 10 may further comprise lateral rods 413 and 423 that are formed lengthways in the length direction L of the distribution tray 40 and attached to the sidewalls formed on either side of the width direction W of the distribution tray 40. The lateral rods 413 and 423 may be formed in the shape of a pipe.

The lateral rods 413 may be attached to the sidewalls of the first distribution tray 41. The lateral rods 423 may be attached to the sidewalls of the second distribution tray 42.

The lateral rods 413 and 423 may be placed in such a way as to protrude outward from the sidewalls formed on either side of the width direction W of the distribution tray 40. The lateral rods 413 and 423 may be attached along the length direction L to the side of the distribution tray 40.

The lateral rods 413 and 423 prevent deformation of the distribution tray 40 due to the stagnation pressure of refrigerant by reinforcing the rigidity of the distribution tray 40. For example, they may prevent the distribution tray 40 from warping downward by the force exerted in a direction perpendicular to the length direction. Accordingly, the lateral rods 413 and 423 may be preferably made of a highly rigid material.

The portions of the sidewalls of the distribution tray 40 that make contact with the lateral rods 413 and 4123 may be bent outward. That is, the sidewalls may be bent and make contact with the sides and tops of the lateral rods 413 and 423. The bending of the sidewalls increases the rigidity of the distribution tray 40 against warping.

The lateral rods 413 may be supported by the upper guides 54.

The bottoms of the lateral rods 413 may be supported by making contact with the tops of the protruding upper guides 54. Since the upper guides 54 transmit force not directly to the distribution tray 40, but to the lateral rods 413 which reinforce rigidity, deformation of the distribution tray 40 may be minimized.

Moreover, when mounting the distribution tray 40, the upper guides 54 guide the insertion of the distribution tray 40 by making contact with the lateral rods 413, thus making the insertion of the distribution tray 40 smoother.

The tube support 50 may have a slit 53 in which the distribution tray 40 is inserted. The distribution tray 40 may be a second distribution tray 42. The slit 53 may be formed between the upper heat transfer tubes P1 and the lower heat transfer tubes P2.

The slit 53 may have a shape into which the distribution tray 40 can be inserted. For example, the slit 53 may have a rectangular shape, as depicted in the figures.

The slit 53 may be aligned horizontally to the ground. The distribution tray 40 may be inserted into the slit 53 and kept horizontal to the ground. The lower side of the slit 53 may support the distribution tray 40 by making contact with the bottom of the distribution tray 40.

The tube support 50 is fixed to the inner periphery of the housing 11 as a bundle of heat transfer tubes P passed through it are kept horizontal within the housing 11. Accordingly, if the slit 53 is formed in the tube support 50, the distribution tray 40 may be horizontally aligned more correctly and supported more stably.

Moreover, when mounting the distribution tray 40, the slit 53 guides the insertion of the distribution tray 40, thus simplifying the installation process. By inserting the distribution tray 40 through the slits 53 formed in the plurality of horizontally arranged tube supports 50, the distribution tray 40 may be guided to its position more correctly and supported more stably.

The tube support 50 may comprise lower guides 531 that protrude inward from the side of the slit 53 and guide the insertion of the distribution tray 40. The distribution tray 40 may be a second distribution tray 42.

The lower guides 531 may protrude inward from either side of the slit 53 and be formed adjacent to the sidewalls of the distribution tray 40.

The lower guides 531 may support the distribution tray 40. For example, the lower guides may support both sides of the bottom of the distribution tray 40. In another example, the lower guides 531 may support both sides of the bottom of the distribution tray 40. In another example, the lower guides 531 may support portions that are bent outward from the sidewalls of the distribution tray 40.

When mounting the distribution tray 40 within the housing 11, the lower guides 53 guides the insertion of the distribution tray 40 into the housing 11. At this point, the distribution tray 40 is positioned between the lower guides 531, and the distribution tray 40 is seated on the lower side of the tube support 50 or hung on the lower guides 531. Afterwards, when the distribution tray 40 is pushed in the length direction of the housing 11, the lower guides 531 guide the insertion of the distribution tray 40, thereby greatly simplifying the installation process.

When the distribution tray 40 is passed through the slit 53, burrs or tips 4111 and 4211 formed around the plurality of holes 411 and 421 of the distribution tray 40 may be caught on the lower side of the slit 53. Accordingly, to avoid this problem, the distribution tray 40 guided by the lower guides 531 may be placed at a distance above the lower side of the tube support 50.

For example, it is desirable that the distribution tray 40 be placed about 5 mm apart from the lower side of the slit 53 so as to keep the lower side of the slit 53 from making contact with the burrs or tips 4111 and 4211.

The lower guides 531 may support the lateral rods 423 protruding from the sidewalls of the distribution tray 40.

The bottoms of the lateral rods 423 may be supported by making contact with the tops of the protruding upper guides 531. Since the upper guides 531 transmit force not directly to the distribution tray 40, but to the lateral rods 423 which reinforce rigidity, deformation of the distribution tray 40 may be minimized.

Moreover, when mounting the distribution tray 40, the lower guides 531 guide the insertion of the distribution tray 40 by making contact with the lateral rods 423, thus making the insertion of the distribution tray 40 smoother.

Guide plates 427 may be further comprised which are placed on either side of the second distribution tray 42 and guide refrigerant falling from the upper heat transfer tubes P1 to be introduced into the second distribution tray 42.

Once liquid refrigerant is distributed over the upper heat transfer tubes P1 and forms a liquid film, part of the liquid refrigerant changes its phase to vapor refrigerant and the non-evaporated liquid refrigerant falls in the direction of the second distribution tray 42. At this point, the vapor refrigerant flows between the side and the top by the suction force of the compressor 2 and then moves to the refrigerant outlet 13. The vapor refrigerant collides with the falling liquid refrigerant, thus causing the liquid refrigerant to be dispersed on both sides. In this case, the liquid refrigerant may be dispersed outward from the second distribution tray 42, thus leading to a decrease in heat exchange efficiency.

Accordingly, the guide plates 427 may be mounted to keep the liquid refrigerant falling from the upper heat transfer tubes P1 from moving outward but instead to allow it to be introduced into the second distribution tray 42.

The guide plates 427 may be placed on the sidewalls of the second distribution tray 42. The guide plates 427 may be slanted so as to catch the falling liquid refrigerant and make it flow to the second distribution tray 42. The guide plates 427 may be formed in a plate shape.

The guide plates 427 may be placed over a larger area than the entire width of the upper heat transfer tubes P1 arranged in the width direction W.

When mounting the guide plates 427, the entire sequence of steps of the installation process may be slightly changed. For example, referring to FIG. 2, one tube support 50 may be fixed to the center of the housing 11 first, and then the distribution tray 40 may be inserted into the slit 53 of the tube support 50 and a guide plate 427 may be attached to the distribution tray 40 and the tube support 50. Afterwards, the distribution tray 40 may be passed through the slit 53 of another tube support 50 and mounted within the housing 11. Next, another guide plate 427 may be attached to the distribution tray 40 and the tube support 50. Afterwards, the heat transfer tubes P may be passed through the holes of the tube support 50.

The evaporator 10 may further comprise at least one of a perforated plate 479 and a demister 479, which is attached to the side of the second distribution tray 42 and extends to the inner surface of the housing 11. This will be described in detail later.

The evaporator 10 may further comprise a tray bracket 425 that is attached to a sidewall of the distribution tray 40 and extends to the inner surface of the housing 11.

The tray bracket 425 may protrude outward from the sidewall of the distribution tray 40. The tray bracket 425 may be attached to the housing 11 and support the side of the distribution tray 40. The tray bracket 425 may be mounted on the edge of the distribution tray 40 after the distribution tray 40 is inserted into the housing 11. The tray bracket 425 helps distribute the load on the distribution tray 40 and maintain balance on the edge of the distribution tray 40.

Figure 5:
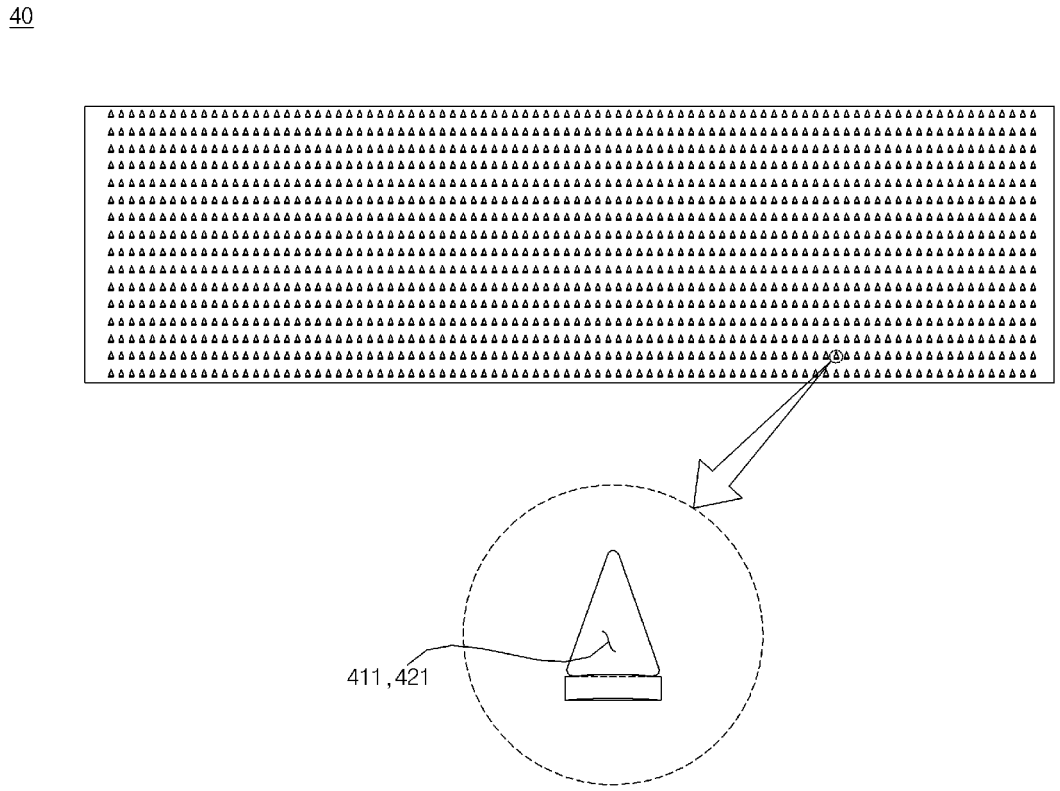
FIGS. 5 and 6 are views illustrating the distribution tray 40 of FIG. 2.
Figure 6:
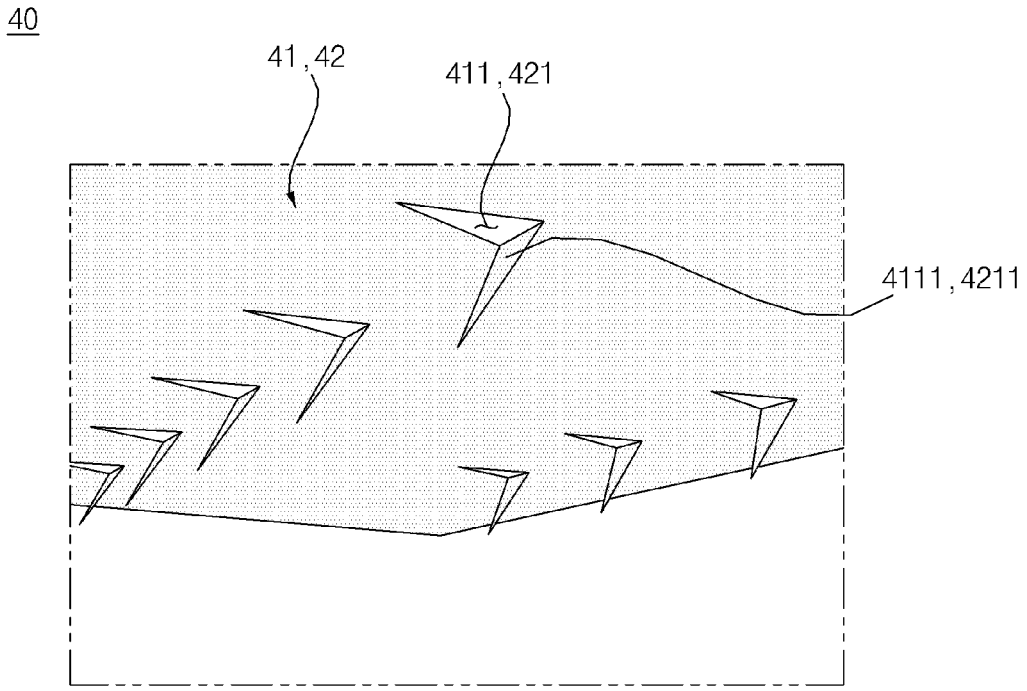

In FIGS. 5 and 6, the structure and workings of the distribution tray 40 will be illustrated.

Referring to FIGS. 5 and 6, the distribution tray 40 may have a plurality of holes 411 and 421 in the bottom surface.

The liquid refrigerant contained in the distribution tray 40 falls through the holes 411 and 412 and is distributed over the heat transfer tubes P.

The intervals between the plurality of holes 411 and 412 and the size of the holes 411 and 421 may be determined experimentally.

For example, the plurality of holes 411 and 421 may be spaced at regular intervals so that no dry-out points are created on the heat transfer tubes P.

If the intervals are too wide, it may create dry-out points whereby no liquid film is formed.

If the intervals are too narrow, it may cause an uneven distribution due to the surface tension of the liquid refrigerant or thicken the liquid film formed on the heat transfer tubes by the liquid refrigerant, thus leading to a decrease in heat exchange efficiency. Accordingly, it is desirable to at least take the above factors into consideration when setting the intervals between the plurality of holes 411 and 421.

The number of the holes 411 and 421 and the size of the holes 411 and 421 may be taken into consideration so that the distribution tray 40 contains a constant amount of liquid refrigerant based on the amount of liquid refrigerant supplied to the distribution tray 40. It is desirable that the amount of liquid refrigerant supplied to the distribution tray 40 and the amount of liquid refrigerant distributed over the heat transfer tubes P by the distribution tray 40 are equal.

The holes 411 and 421 may be made in a variety of shapes. Preferably, they may be shaped in such a way that the surface tension of the liquid refrigerant is decreased so as to distribute the liquid refrigerant evenly over the heat transfer tubes P.

Referring to FIG. 6, the distribution tray 40 may comprise tips 4111 and 4211 that are formed under the holes 411 and 421. The tips 4111 and 4211 may be formed in the shape of a triangular surface.

The holes 411 and 421 may be formed by cutting the bottom surface of the distribution tray 40. The holes 411 and 421 each may be formed by cutting part of the periphery of a hole and bending the hole-forming portion downward along the line passing through the midpoint of the uncut side.

For example, the holes 411 and 421 may have a triangular shape. The holes 411 and 421 each may be formed by cutting two sides of the triangle and bending the triangular-shaped surface of the hole-forming portion downward along the line passing through the midpoint of the uncut side.

For example, the holes 411 and 421 may have a polygonal or circular shape. The holes 411 and 421 each may be cut in such a way as to have a plurality of sides including a side angled at less than 180 degrees. At this point, the holes 411 and 421 may be formed by bending the plurality of sides downward. The side angled at less than 180 degrees may be positioned under the holes 411 and 421, and the opposite side may correspond to part of the periphery of the holes 411 and 421.

The tips 4111 and 4211 each may comprise a portion where the angle between two sides of one end is less than 180 degrees. The one end may be positioned under the holes 411 and 412. The tips 4111 and 4211 are slanted downward so that the one end is positioned below the other end.

The one end of the tips 4111 and 4211, which has an angle of less than 180 degrees, is positioned under the holes, and the other end opposite the one end, that is, the opposite side of that angle, may form part of the periphery of the holes 411 and 421.

If the tips 4111 and 4211 are formed under the plurality of holes 411 and 421 of the distribution tray, liquid refrigerant released down the holes falls and collects at the edges of the tips, thereby decreasing the surface area and surface tension of the liquid refrigerant. Accordingly, the liquid refrigerant may be distributed more evenly without being concentrated.

In FIGS. 7 to 11, the structure and workings of the vapor-liquid separator 20 will be illustrated.

Referring to FIGS. 7 to 10, the vapor-liquid separator 20 may comprise a refrigerant inlet 12 and an inlet port 22 penetrating part of the topside of the chamber 21, through which mixed refrigerant is introduced.

The vapor-liquid separator 20 may comprise a baffle tube 23 that communicates with the inlet port 22 and separates the introduced mixed refrigerant and distributes it into the chamber 21. The baffle tube 23 may be formed lengthways in the length direction L of the chamber 21 inside the chamber 21. The baffle tube 23 may be formed in the shape of a tube whose cross section is circular or polygonal.

The baffle tube 23 may be placed in a direction not parallel to the direction in which the mixed refrigerant is introduced from the inlet port 22. The baffle tube 23 may intersect a virtual surface extending in the length direction of the inlet port 22.

The baffle tube 23 may be formed in such a way that a mixed refrigerant flowing at a high flow rate collides with the inner periphery of the baffle tube 23, thereby slowing down and stabilizing the flow rate of the mixed refrigerant. Since the flow rate of the mixed refrigerant is slowed down and stabilized, the mixed refrigerant is separated into vapor refrigerant and liquid refrigerant due to the difference in density.

After the collision, the liquid refrigerant collects at the bottom of the baffle tube 23. The separated liquid refrigerant is distributed into the chamber 21. Once distributed into the chamber through the stabilization process, the liquid refrigerant may be contained in a lower part of the chamber 21 and distributed to the distribution tray via the holes formed in the bottom of the chamber 21.

As the separated vapor refrigerant flows above the liquid refrigerant, it may be introduced into the compressor 2 through the baffle tube 23, vapor refrigerant exit 213, and refrigerant outlet 13 due to the suction force of the compressor 2.

Figure 7:
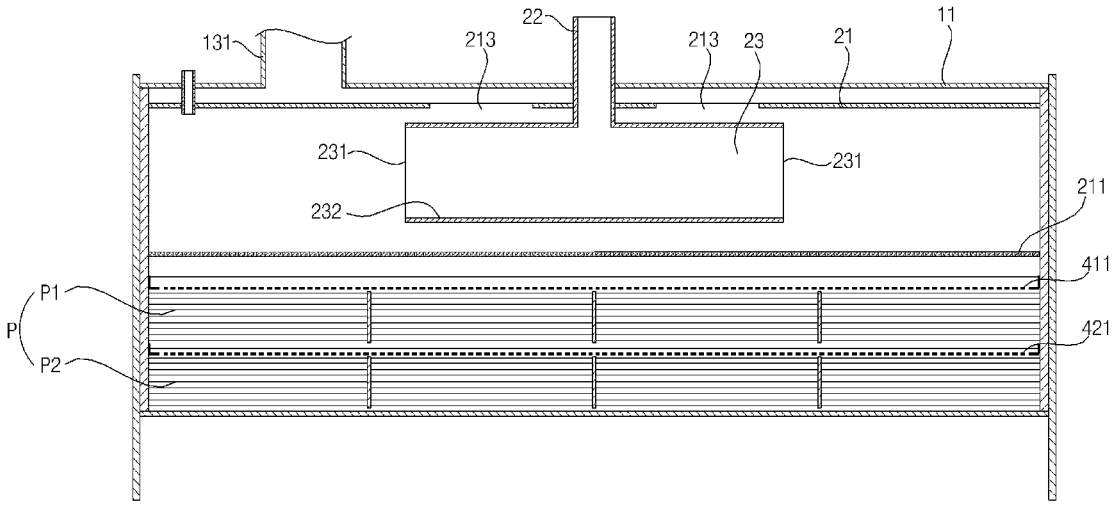
FIG. 7 is a cross-sectional view taken along the line II-II' of FIG. 2 according to a first exemplary embodiment.
Figure 8:
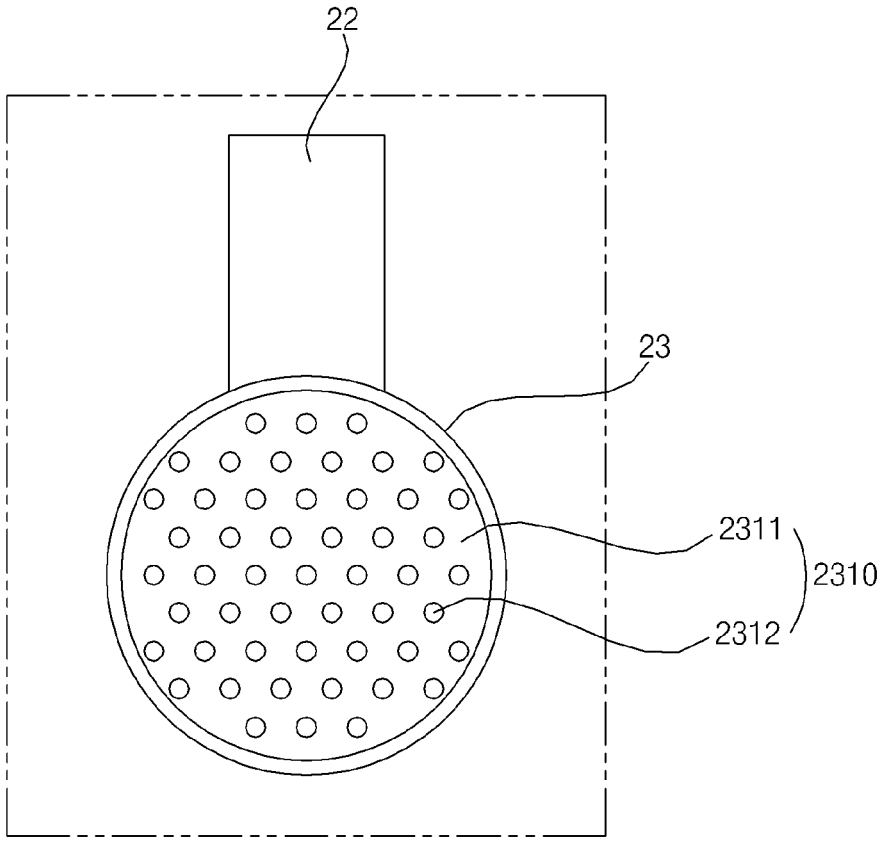
FIG. 8 is a side view illustrating the baffle tube 23 of FIG. 7 according to one embodiment.
Figure 9:
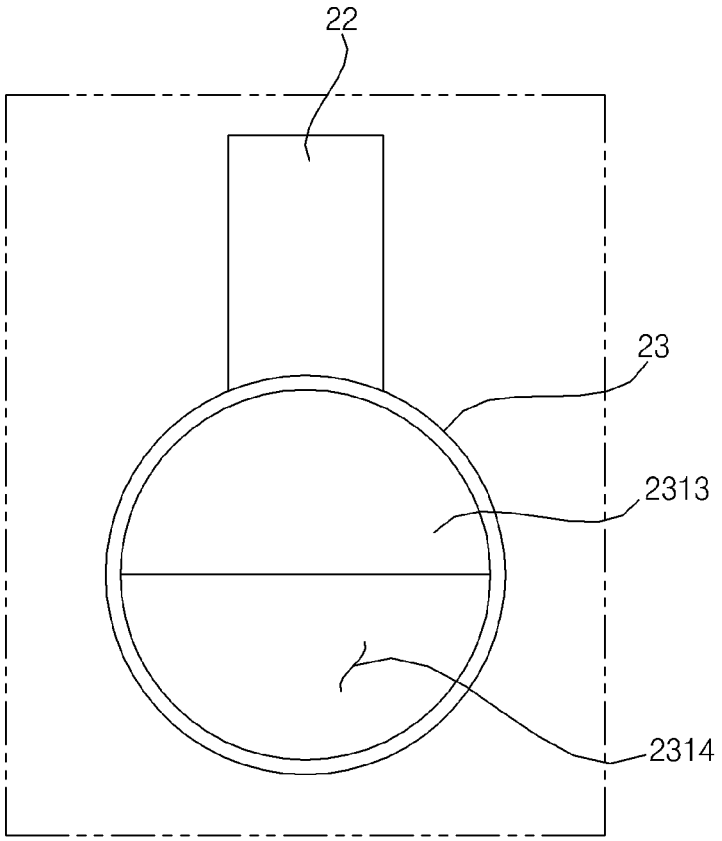
FIG. 9 is a side view illustrating the baffle tube 23 of FIG. 7 according to another embodiment.

Referring to FIGS. 7 to 9, the baffle tube 23 may comprise an opening 231 which is open at the ends. The opening 231 may be formed on either end of the baffle tube 23.

The stabilized refrigerant is released through the openings 231 formed in the baffle tube 23. The liquid refrigerant is distributed to the lower side of the chamber 21 through the openings 231, and the vapor refrigerant flows to the upper side of the chamber 21 through the openings 231.

Meanwhile, if the mixed refrigerant collides with the inner periphery of the baffle tube 23, the flow rate of the mixed refrigerant slows down but the fluid flow is partially disturbed by the mixed refrigerant continuously introduced at a high flow rate and a vortex is generated around the periphery. Once a vortex is generated, part of the liquid refrigerant is not separated but dispersed on all sides in the direction of the vortex. The dispersed liquid refrigerant is not evenly distributed over the lower side of the chamber 21, and may be released along with the vapor refrigerant.

To solve the above problems, the baffle tube 23 may comprise a perforated plate 2310 with a plurality of holes that is mounted at the opening 231. Alternatively, the baffle tube 23 may comprise a covering plate 2313 that closes an upper part of the opening 231.

The perforated plate 2310 and the covering plate 2313 further stabilize the vapor refrigerant and liquid refrigerant entrained in the vortex when they are released from the baffle tube 23.

Refrigerant is released from the baffle tube 23 via a plurality of holes 2312 formed in a plate 2311 of the perforated plate 2310. Liquid refrigerant is released via holes formed in a lower part of the plate 2311, and vapor refrigerant is released via holes formed in an upper part thereof.

The covering plate 2313 covers the upper part of the opening 231 with a plate, and has an aperture 2314 at the bottom. The aperture 2313 prevents the liquid refrigerant from being dispersed upward and released along with the vapor refrigerant.

Figure 10:
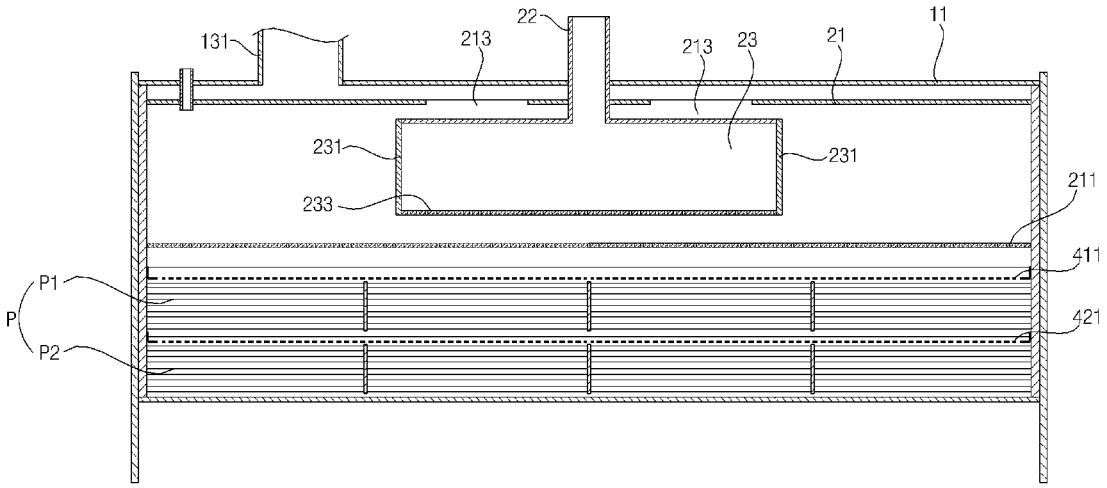
FIG. 10 is a cross-sectional view taken along the line II-II' of FIG. 2 according to a second exemplary embodiment.

Referring to FIG. 10, the baffle tube 23 may have a plurality of holes 234 at the bottom.

In this case, the flow rate of mixed refrigerant introduced into the baffle tube 23 is slowed down and stabilized as the mixed refrigerant collides with the bottom. The stabilized liquid refrigerant and vapor refrigerant are released out of the baffle tube 23 via the holes formed at the bottom of the baffle tube 23. With a slower flow rate, the mixed refrigerant is released out of the baffle tube 23 and separated due to the difference in density.

The liquid refrigerant is distributed downward toward the bottom surface of the chamber 21 via the holes 234 at the bottom of the baffle tube 23. The liquid refrigerant may collect at the bottom of the baffle tube 23 and maintain a certain water level. The size or number of the holes and the intervals between the holes may be set based on the amount of liquid refrigerant that can be distributed to the lower part of the chamber 21 while maintaining a certain water level on the lower side of the baffle tube 23.

The separated vapor refrigerant is released out of the baffle tube 23 via the holes 23 at the bottom of the baffle tube 23 and is then introduced into the vapor refrigerant exit 213 formed in the upper part of the chamber 21 by the suction force of the compressor 2.

Figure 11:
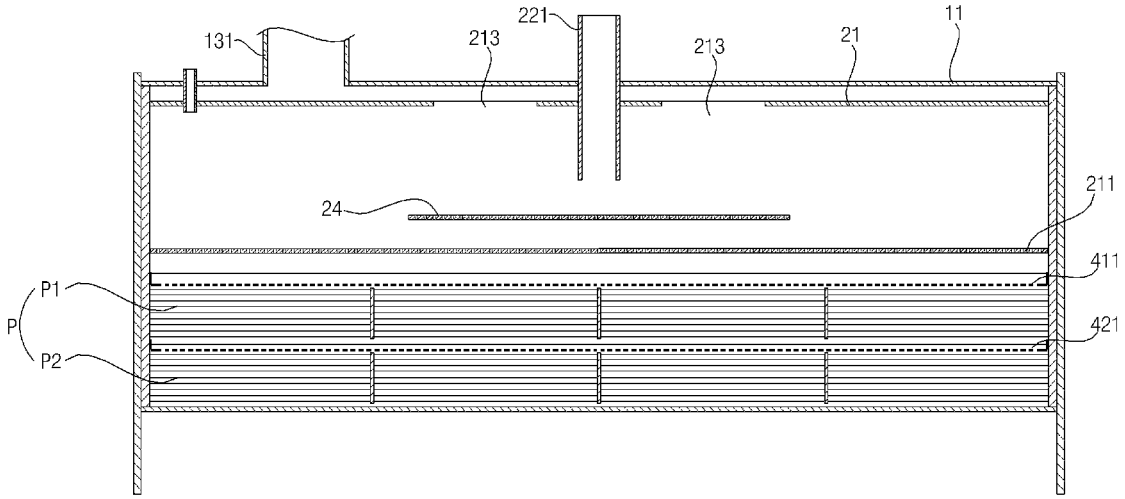
FIG. 11 is a cross-sectional view taken along the line II-II' of FIG. 2 according to a third exemplary embodiment.

Referring to FIG. 11, the inlet port 22 may extend downward and longitudinally, so that part of it is positioned inside the chamber 21. In this case, the vapor-liquid separator 20 may comprise a baffle plate 24 that is contained inside the chamber 21 and placed between the lower end of the chamber 21 and the lower end of the inlet port 22.

The inlet port 22 may be placed vertically to the chamber 21. The baffle plate 24 may be placed horizontally to the chamber 21. The baffle plate 24 may be placed apart from the inlet port 22. Also, the baffle plate 24 may be placed apart from the holes at the bottom of the chamber 21.

The baffle plate 24 may be formed in the shape of a plate with a plurality of holes formed in it. When a mixed refrigerant is introduced into the chamber 21 through the inlet port 22, its flow rate is slowed down and stabilized due to the collision between the mixed refrigerant and the baffle plate 24.

The stabilized mixed refrigerant is separated into a liquid refrigerant and a vapor refrigerant. The separated liquid refrigerant may be distributed downward along the side of the baffle plate 24. If the baffle plate 24 has a plurality of holes, the liquid refrigerant may be distributed downward via the holes. The separated vapor refrigerant is introduced into the vapor refrigerant exit 213 of the chamber 21.

Referring to FIGS. 7 to 11, an opening may be formed on the side of the baffle tube 23, and a vapor refrigerant exit may be formed on the upper end of the chamber 21. The distance from the opening to an end of the chamber 21 may be shorter than the distance from an end of the vapor refrigerant exit 213 to the end of the chamber 21.

In this case, refrigerant may be released from the side or bottom of the baffle tube 23 and turn its direction of flow to flow toward the vapor refrigerant exit 213. This reduces the possibility that the liquid refrigerant with a higher density will be released out of the vapor refrigerant exit 213 along with the vapor refrigerant, when the vapor refrigerant and the liquid refrigerant flow together toward the vapor refrigerant exit 213 of the chamber 21.

The vapor-liquid separator 20 may comprise a demister that is placed at the vapor refrigerant exit 213.

The demister is a device for removing liquid entrained in a fluid. The demister prevents a liquid refrigerant from entering the compressor 2 from the vapor-liquid separator 20. The demister functions as a filter at the vapor refrigerant exit 213 to pass only the vapor refrigerant through.

Figure 13:
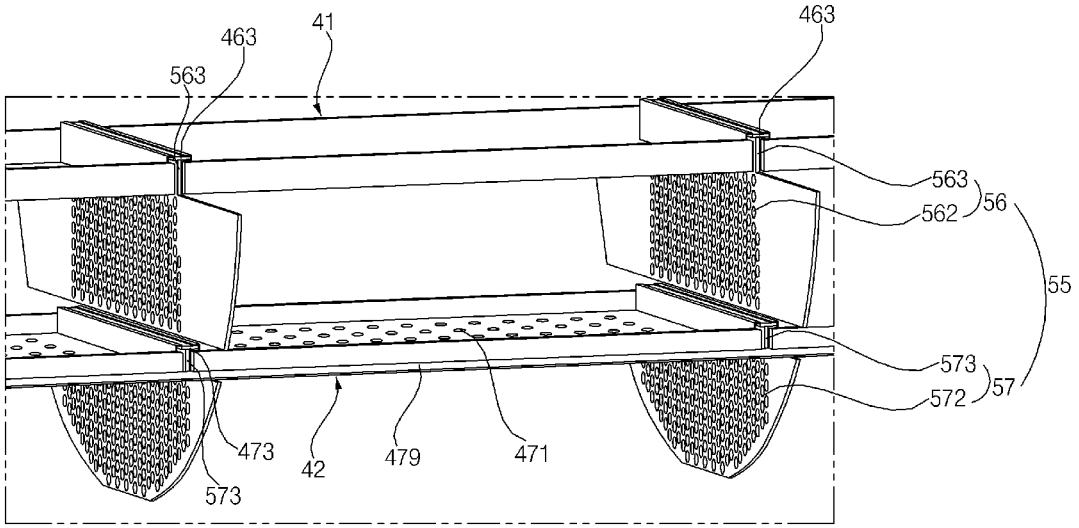
FIG. 13 is a partial enlarged perspective view of FIG. 12.
Figure 14:
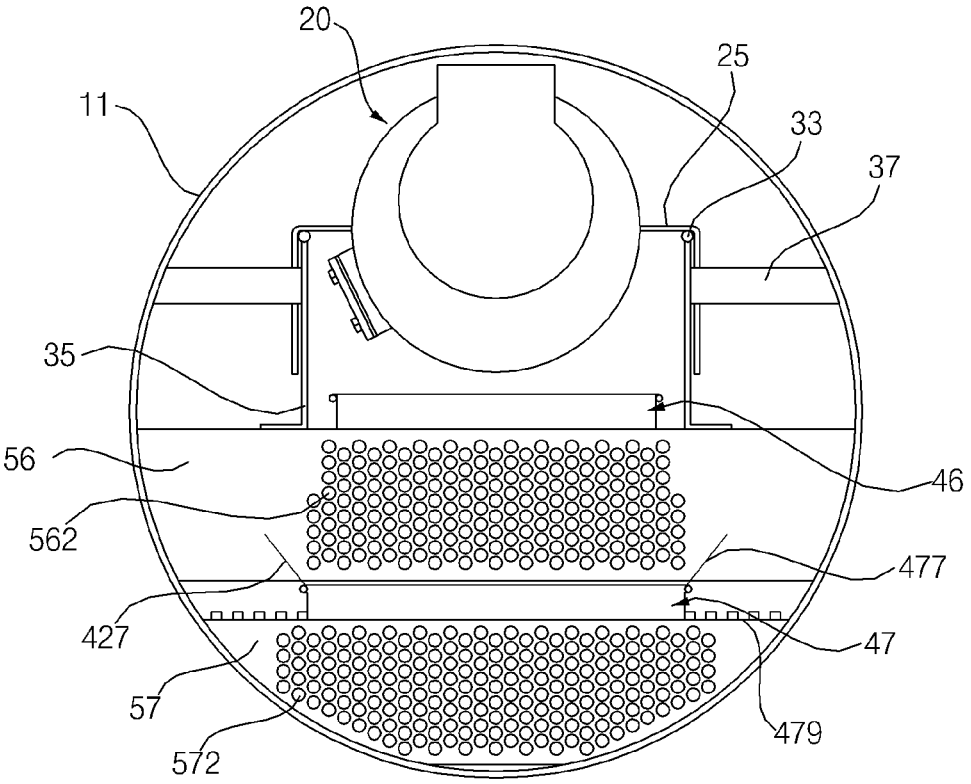
FIG. 14 is a cross-sectional view taken along the line III-III' of FIG. 12.

FIGS. 12 to 14 are views for illustrating the structure and workings of an evaporator according to an exemplary embodiment of the present disclosure.

The structure applied in FIGS. 2 to 11 may be equally applicable to the structure of the evaporator 10 illustrated in FIGS. 12 to 14.

For example, the distribution tray 40 explained with reference to FIGS. 5 and 5 may apply equally to the evaporator 10 according to the embodiment of FIGS. 12 to 14.

For example, the vapor-liquid separator 20 explained with reference to FIGS. 7 to 11 may equally apply to the evaporator 10 according to the embodiment of FIGS. 12 to 14.

The following description of FIGS. 12 to 14 focuses on the differences with the evaporator according to the embodiment of FIGS. 2 to 4.

Referring to FIGS. 12 and 14, the support frames 30 may further comprise a plurality of second brackets 35 that are fixed to the top of the tube support 55 and connected to the rail rods 31.

The second brackets 35 each may comprise a surface that makes contact with the top surface of the tube support 55. The second brackets 35 may be formed in an "L" shape. The plurality of second brackets 35 placed on either side may come into contact with the tube support 55 near the sidewalls formed on either side of the width direction W of the distribution tray 45.

The tube support 55 is fixed to the inner periphery of the housing 11 as a bundle of heat transfer tubes P passed through them are kept horizontal within the housing 11. Accordingly, the second brackets 35 allows the rail rods 31 to be horizontally aligned more correctly and supports the vapor-liquid separator 20 more stably.

The second brackets 35 may be spaced apart from the sidewalls of the distribution tray 45. Alternatively, the second brackets 35 may support the sidewalls of the distribution tray 45 without being spaced apart from the sidewalls of the distribution tray 45.

The second brackets 35 also may apply to the embodiment described with reference to FIGS. 2 to 11.

Referring to FIGS. 12 and 13, the distribution tray 45 may have insertion openings 463 and 473 that are recessed on the top so that at least part of upper portions 563 and 573 of the tube supports 55 are inserted therein to support the distribution tray 45.

The upper portions 563 and 573 of the tube support 55 may be protrusions 563 and 573 which partially protrude. The upper portions of the tube supports 55 may have a T-shape. In this case, the protrusions 563 and 573 having a T-shape may be inserted into the insertion openings 463 and 473.

The tube support 55 is fixed to the inner periphery of the housing 11 as a bundle of heat transfer tubes P passed through them are kept horizontal within the housing 11. Also, at least part of the upper portions of the tube supports 55 are inserted into the insertion openings 463 and 473 of the distribution tray 45. The distribution tray 45 in which the tube support 55 is partially inserted may be horizontally aligned correctly and supported mores stably by the tube support 55.

In a case where a plurality of tube supports 55 are arranged in the length direction L of the housing 11, the protrusions 563 and 573 of the plurality of tube supports 55 may be inserted into a plurality of insertion openings 463 and 473 formed in the distribution tray 45.

Referring to FIGS. 12 to 14, the tube support 55 may comprise an upper tube support 56 that is inserted into an insertion opening 463 formed in the first distribution tray 46 and has a plurality of holes for passing the upper heat transfer tubes P1 through. Also, the tube support 55 may comprise a lower tube support 57 that is inserted into an insertion opening 473 formed in the second distribution tray 47 and has a plurality of holes for passing the lower heat transfer tubes P2 through.

As above, when a plurality of distribution trays 45 are used, the upper tube support 56 and lower tube support 57 for supporting the plurality of distribution trays 45 may be further comprised. At least part of the periphery of the upper tube support 56 and lower tube support 57 may contact with the inner periphery of the housing 11. The upper tube support 56 and the lower tube support 57 may be spaced apart from each other.

On the contrary, in an example, the upper tube support 56 and the lower tube support 57 may not be spaced apart from each other, with the second distribution tray 47 in between. In this case, the upper end surface of the insertion opening 473 of the second distribution tray 47 supported by the lower tube support 57 make contact with part of the lower surface of the upper tube support 56. Accordingly, it allows the upper tube support 56 to be supported by the lower tube support 57, and helps better keep the upper tube support 56 and the lower tube support 57 horizontal to each other.

In another example, at least part of the upper portion of the tube support 55 may be inserted into the insertion opening 463 formed in the first distribution tray 46, and the second distribution tray 47 may be inserted through the above-described slits 53 formed in the tube support 55. In this case, the first distribution tray 46 may be supported by at least part of the upper portion of the tube support 55, and the second distribution tray 47 may be supported by the lower surface of the slit 53.

The evaporator 10 may further comprise a perforated plate 479 that is attached to the side of the second distribution tray 46 and extends to the inner surface of the housing 11. The perforated plate 479 may be in the shape of a plate with a plurality of holes formed in it. The perforated plate 479 may be supported by the lower tube supports 55.

Alternatively, the evaporator 10 may further comprise a demister 479' that is attached to the side of the second distribution tray 47 and extends to the inner surface of the housing 11. The demister 479' may be placed in a position where the perforated plate 479 is supposed to be, in place of the perforated plate 479.

The perforated plate 479 and the demister 479' may be formed lengthways in the length direction of the second distribution tray 47.

As a vapor refrigerant generated through evaporation from the lower heat transfer tubes P2 may flow to the side and then upward, it may be released along with any entrained liquid refrigerant. In this case, the perforated plate 479 and the demister 479' may prevent the vapor refrigerant generated through evaporation from the lower heat transfer tubes P2 from being released along with any entrained liquid refrigerant.

The perforated plate 479 or the demister 479' may extend horizontally from the side of the second distribution tray 45 to the inner surface of the housing 11. In this case, as depicted in the drawings, the T-shaped upper portions 573 of the lower tube supports 55 may support the second distribution tray 45 through the protruding portions, and may support the perforated plate 479 or the demister 479' through the non-protruding upper surfaces.

Guide plates 477 may be further comprised which are placed on either side of the second distribution tray 45 and guide refrigerant falling from the upper heat transfer tubes P1 to be introduced into the second distribution tray 45.

While the exemplary embodiments of the present disclosure have been illustrated and described above, the present disclosure is not limited to the aforementioned specific exemplary embodiments, various modifications may be made by a person with ordinary skill in the art to which the present disclosure pertains without departing from the subject matters of the present disclosure that are claimed in the claims, and these modifications should not be appreciated individually from the technical spirit or prospect of the present disclosure.

An evaporator according to the present disclosure offers one or more of the following advantages.

Firstly, the distribution tray can be supported horizontally and stably by means of a tube support, etc.

Secondly, the vapor-liquid separator can be supported horizontally and stably by means of support frames, side arms, etc.

Thirdly, the structural components inside the evaporator, such as the vapor-liquid separator, the distribution tray, etc., may be supported by means of components such as rail rods, upper guides, and slits, and, at the same time, the installation process can be simplified.

The advantageous effects of the present disclosure are not limited to the foregoing, and other advantageous effects not mentioned herein will be clearly understood by those skilled in the art from the appended claims.

What is claimed is:

1. An evaporator, comprising:

a housing with a refrigerant inlet and a refrigerant outlet;

heat transfer tubes that are contained in the housing, in which chilled water for heat exchange with refrigerant inside of the housing flows;

at least one distribution tray that is placed apart from the heat transfer tubes and has a plurality of holes for distributing refrigerant over the underlying heat transfer tubes;

a vapor-liquid separator that is placed above the distribution tray and separates an introduced mixed refrigerant into vapor refrigerant and liquid refrigerant and distributes the liquid refrigerant to the distribution tray;

at least one tube support with a plurality of holes for passing the heat transfer tubes through, that is placed inside of the housing and supports the distribution tray; and a pair of support frames that is fixed to either side of a widthwise direction of the housing, wherein the vapor-liquid separator comprises a plurality of side arms that is arranged in a lengthwise direction of the vapor-liquid separator and supported by the pair of support frames.

2. The evaporator of claim 1, wherein the pair of support frames comprises rail rods that are formed lengthways in the lengthwise direction of the vapor-liquid separator so as to support the plurality of side arms and guide insertion of the vapor-liquid separator.

3. He evaporator of claim 2, wherein the pair of support frames comprises a plurality of first brackets that is connected to the rail rods and fixed to the housing.

4. The evaporator of claim 3, further comprising a bridge rod attached to ends of the at least one distribution tray and ends of the housing, wherein at least one of the plurality of first brackets is attached to the bridge rod.

5. The evaporator of claim 2, wherein the pair of support frames further comprises a plurality of second brackets that is fixed to a top of the at least one tube support and connected to the rail rods.

6. The evaporator of claim 2, wherein the plurality of side arms is bent at portions that make contact with the rail rods.

7. An evaporator, comprising:

a housing with a refrigerant inlet and a refrigerant outlet;

heat transfer tubes that are contained in the housing, in which chilled water for heat exchange with refrigerant inside of the housing flows;

at least one distribution tray that is placed apart from the heat transfer tubes and has a plurality of holes for distributing refrigerant over the underlying heat transfer tubes;

a vapor-liquid separator that is placed above the distribution tray and separates an introduced mixed refrigerant into vapor refrigerant and liquid refrigerant and distributes the liquid refrigerant to the distribution tray; and a tube support with a plurality of holes for passing the heat transfer tubes through, that is placed inside of the housing and supports the distribution tray, wherein the tube support comprises upper guides that protrude to the left and the right from a top of the tube support, respectively, to form a space where insertion of the distribution tray is guided, and supports the distribution tray.

8. The evaporator of claim 1, wherein the at least one tube support has a slit into which one of the at least one distribution tray is inserted.

9. The evaporator of claim 8, wherein the at least one tube support comprises lower guides that protrude inward from a side of the slit, support lateral rods protruding from sidewalls of the distribution tray, and guide insertion of the distribution tray.

10. The evaporator of claim 1, wherein the distribution tray has an insertion opening that is recessed on a top so that at least a portion of an upper portion of the at least one tube support is inserted therein to support the distribution tray.

11. The evaporator of claim 1, wherein the at least one tube support comprises a plurality of tube supports arranged in a lengthwise direction of the housing, with tops thereof being on a same level, and at least a portion of sides of the plurality of tube supports contacts an inner surface of the housing.

12. The evaporator of claim 7, further comprising lateral rods that are formed lengthways in a lengthwise direction of the distribution tray and attached to sidewalls of the distribution tray and supported by the upper guides.

13. An evaporator, comprising:

a housing with a refrigerant inlet and a refrigerant outlet;

heat transfer tubes that are contained in the housing, in which chilled water for heat exchange with refrigerant inside of the housing flows;

at least one distribution tray that is placed apart from the heat transfer tubes and has a plurality of holes for distributing refrigerant over the underlying heat transfer tubes;

a vapor-liquid separator that is placed above the distribution tray and separates an introduced mixed refrigerant into vapor refrigerant and liquid refrigerant and distributes the liquid refrigerant to the distribution tray;

a tube support with a plurality of holes for passing the heat transfer tubes through, that is placed inside of the housing and supports the distribution tray; and a tray bracket that is attached to a sidewall of the distribution tray and extends to an inner surface of the housing.

* * * * *